United States Patent [19]

Whitehead

[11] Patent Number: 4,494,763

[45] Date of Patent: Jan. 22, 1985

[54] WHEELED ROCKER TOY

[76] Inventor: Richard A. Whitehead, 127 East Hoffman, Spokane, Wash. 99207

[21] Appl. No.: 472,949

[22] Filed: Mar. 7, 1983

[51] Int. Cl.[3] ..... A63G 15/00

[52] U.S. Cl. ..... 280/1.175; 272/52.5

[58] Field of Search ..... 280/1.175, 1.182, 1.13, 280/218; D21/68; 272/52, 52.5, 56; 297/270

[56] References Cited

U.S. PATENT DOCUMENTS

| | | | |
|---|---|---|---|
| D. 51,730 | 2/1918 | Marqua | D21/68 |
| D. 72,874 | 6/1927 | Sundbeck | D21/68 |
| D. 143,285 | 12/1945 | DeVorn | D21/70 |
| D. 162,246 | 2/1951 | Smith | D21/68 |
| D. 201,559 | 7/1965 | Peltier | D21/69 |
| D. 216,551 | 2/1970 | Ruby | D21/81 |
| D. 219,608 | 12/1970 | Carver et al. | D21/76 |
| D. 254,561 | 3/1980 | Alley et al. | D21/68 |
| D. 270,023 | 1/1983 | Crandall | D6/114 |
| 2,462,648 | 2/1949 | Kuppin | 280/1.175 |
| 2,913,248 | 11/1959 | Bauer | 280/1.183 |

FOREIGN PATENT DOCUMENTS

| | | | |
|---|---|---|---|
| 746758 | 3/1956 | United Kingdom | 272/52.5 |

*Primary Examiner*—John A. Pekar

*Attorney, Agent, or Firm*—Keith S. Bergman

[57] ABSTRACT

A child's toy having a rider supporting body which is in turn supported on spaced, opposed rockers. The body rotatably supports forward and rearward wheels. The foreward wheel is so positioned that it contacts a supporting surface upon forward rocking motion to allow forward lineal motion of the toy. The rearward wheel aids in preventing rearward tipping of the toy. The body configurationally simulates a motor cycle.

1 Claim, 6 Drawing Figures

FIG. 1
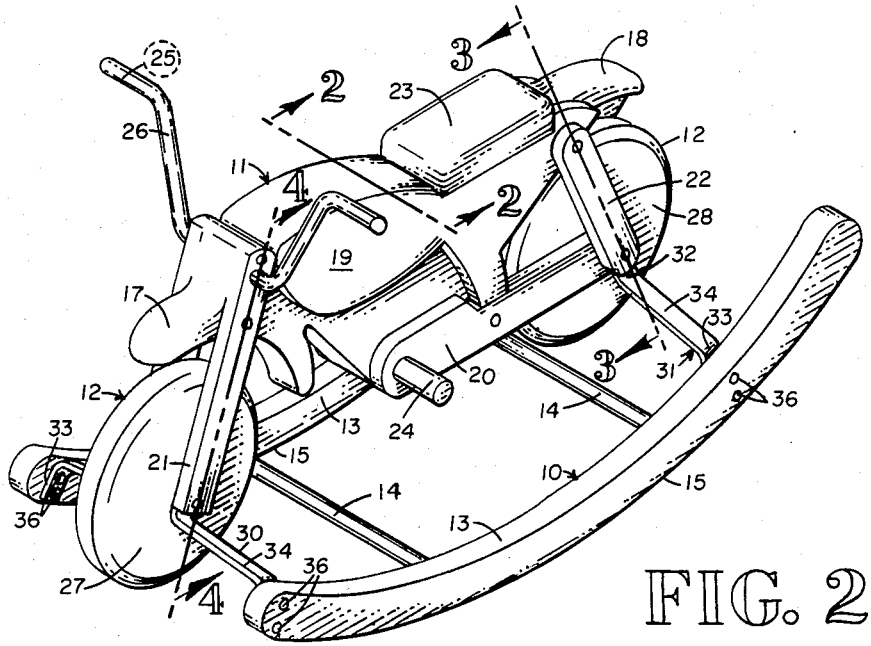
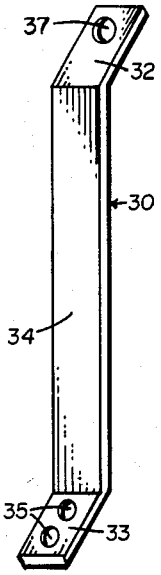
FIG. 5
FIG. 2
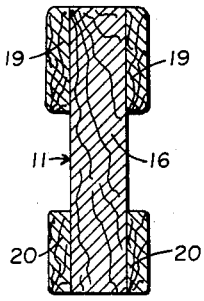
FIG. 4
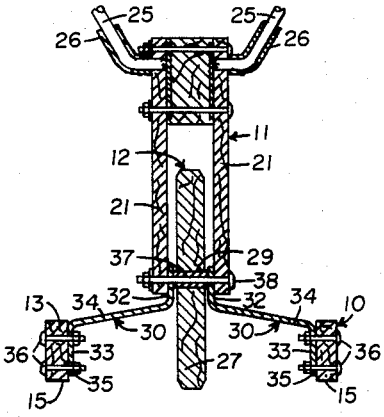
FIG. 3
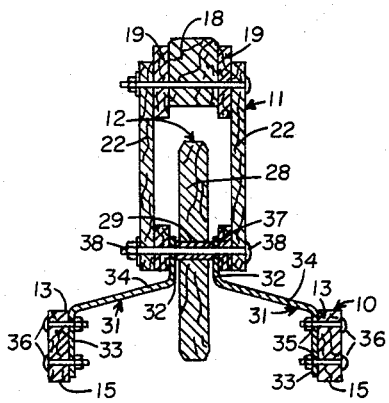
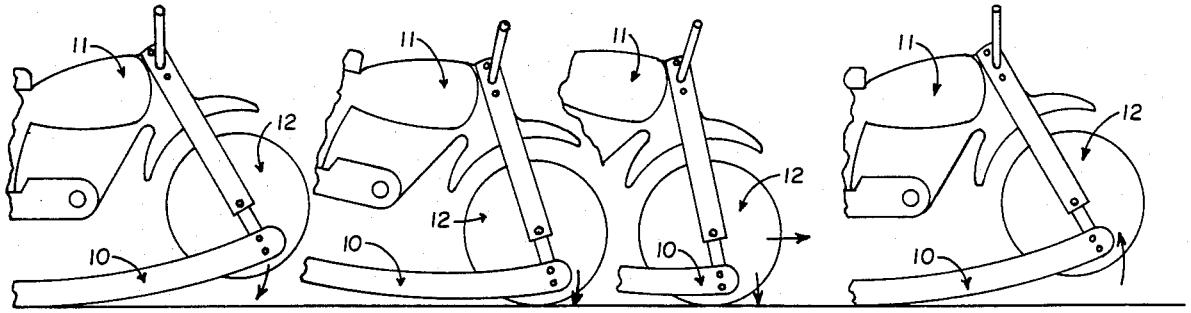
FIG. 6

WHEELED ROCKER TOY

BACKGROUND OF INVENTION

1. Related Applications

There are no applications related hereto heretofore filed in this or any foreign country.

2. Field of Invention

My invention relates generally to rider supporting rocker toys and more particularly to such a toy that has foreward and rearward wheels.

DESCRIPTION OF PRIOR ART

Various rocking toys, epitomized by the rocking horse, have heretofore become known. In general these toys have provided paired, spaced rockers supporting a medial body adapted to carry the user, generally in a seated position. By appropriate body motion the user may cause the device to rock upon and relative to a supporting surface. In general such toys have been supported either completely or substantially by the rocking structure and though they have had a reciprocal rocking action relative to the supporting surface they in general have had no lineal motion relative thereto, except possibly by pure accident and then only when not properly operated.

As opposed to the traditional rocking toy, the instant invention provides a medial body structure that not only supports a rider but also a pair of depending wheels rotatably mounted in its forward and rearward part. The forward wheel is so positioned relative to the rockers that it contacts an underlying supporting surface and supports the lower portion of the toy in the forward part of the rocking cycle but not otherwise. This allows the toy to move forwardly a short distance relative to a supporting surface by reason of the forward force component of each rocking motion.

The rearward wheel is so positioned relative to the rockers that it contacts the underlying supporting surface only at the extreme limit of the rearward rocking motion but not otherwise. This rearward wheel then will not provide any rearward motion for the toy but will act as a support to keep it from rocking too far backwardly so that a user might tip the toy over or fall off of it by reason of its rearward tipping.

The motion of my toy as described creates more and greater stresses and strains upon its structural elements than exist in the ordinary rocking toy and because of this the toy necessarily requires a stronger, more rigid, more durable structure than rocking toys that do not provide for or allow forward linear motion. This heavier structure makes my toy safer in use than the traditional rocking toy.

The body of my device may be quite conveniently and advantageously designed in the configuration of a wheeled vehicle and particularly a motorcycle to especially simulate some measure of realism for a user and provide a logical reason for the positioning and existence of the wheels. The motion of the device is more pleasing and desirable to a user than a pure rocking motion because of both its novelty and variety.

My invention resides not in any one single difference or novelty indicated but rather in the combination of all of the structural features to provide the particular synergystic function of my toy.

SUMMARY OF INVENTION

My invention provides a riding type rocker toy for children that has associated wheel structure.

My toy provides spaced cooperating arcuate rockers supporting a body thereabove and in a medial position therebetween. The body supports a user and provides forward and rearward rotatably mounted depending wheels. The rearward wheel is so positioned as to touch an underlying supporting surface only at the end of the rearward rocking cycle to prevent rearward tipping of the device. The forward wheel is mounted to contact the underlying supporting surface somewhat before the end of the forward rocking cycle for support of the foreward portion of the toy to allow its foreward linear motion over the supporting surface.

The body is configured to simulate a motorcycle and is formed principally of wood to accomodate substantial stresses created therein.

In creating such a device it is:

A principal object of my invention to provide a rocking type toy that has a medial body with depending rotatable wheels to aid in preventing tipping of the device and to allow its lineal locomotion over an underlying supporting surface.

A further object of my invention to provide such a toy that may be formed substantially from wood to provide necessary strength and rigidity to accomodate stresses and strains produced during operation.

A still further object of my invention to provide such a toy that is aesthetically pleasing and tends to simulate the appearance and locomotion of a motorcycle, especially to a young user.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however it is to be understood that its essential features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is an isometric surface view of my invention showing its various parts, their configuration and relationship.

FIG. 2 is a vertical, traverse, cross-sectional view through the medial portion of the body of the device, taken on the line 2—2 of FIG. 1 in the direction indicated by the arrows thereon.

FIG. 3 is a vertically angled, traverse, cross-sectional view through the rear wheel support and bearing structure of my invention, taken on the line 3—3 of FIG. 1 in the direction indicated by the arrows thereon.

FIG. 4 is a vertically angled, traverse, cross-sectional view through the forward wheel support and handle bar structures, taken on the line 4—4 of FIG. 1 in the direction indicated by the arrows thereon.

FIG. 5 is an enlarged isometric view of one of the foreward body supports of my invention to show its structural details.

FIG. 6 is a partial, sequential, diagrammatic view of the foreward rocking cycle of my invention showing the relative positions of the rockers and the front wheel during that cycle.

DESCRIPTION OF THE PREFERRED EMBODIMENT

My invention generally provides rocker structure 10 supporting body element 11 which has pivotably mounted depending wheel structures 12 to provide locomotion and stability.

Rocker structure 10 provides opposed, cooperating rockers 13 interconnected by similar cross-pieces 14. Each rocker is an elongate rigid element of generally arcuate shape having lower surface 15 forming a smooth curve, commonly a sector of a circle. The rockers should have some length to provide stability for the toy during the rocking action and to prevent it from tipping over in a forward or rearward direction. Lower surface 15 of the rockers should have a fairly substantial radium of curvature, generally of at least four to five feet, to provide a more stable motion and prevent severe rocking that might cause tipping. The rockers are generally parallel and should be spaced some distance apart to provide lateral stability for the toy. These general problems and the features providing their solutions have heretofore become known in the rocking toy arts and are not new per se.

The rockers and cross-pieces are preferably formed of wood and their mechanical joinder is accomplished by any of the standard means used to join wood elements, in this case glued mortice and tendon joints.

Body 11 comprises a rigid structure formed by core 16, peripherally shaped to somewhat simulate the body of a motorcycle with forwardmost arcuate fender structure 17 and rearwardmost fender structure 18. Similar opposed side elements 19 extend laterally from structural communication with core 16 to generally simulate the motorcycle driving structure. Similar, opposed, elongate chain elements 20 extend laterally on each side of the lowermost portion of the body to simulate the chain drive structure of a motorcycle and aid in mounting the rear wheel structure in their rearward portion. The forward portion of body 16 provides similar, opposed front wheel supports 21 extending downwardly and somewhat forwardly from structural support on the forward portion of the body to aid in mounting the front wheel structure and, again, simulate the general front fork structure of a motorcycle.

Rear wheel supports 22 are similar, somewhat elongate, rigid elements that extend from structural communication with the upper rearward portion of the body downwardly and somewhat rearwardly to the rearward portion of chain elements 20 to there aid in supporting the rear wheel structure.

The upper rearward portion of the body carries seat 23 which may be solid or upholstered as desired. The lower medial part of the body mounts traversely extending, rod-like foot rest 24 extending laterally from both sides of the forward part of chain elements 22 to provide a foot rest for a user. The upper, forward portion of the body, in the upper part of the front wheel structure supports 21, mounts traditionally shaped rigid handlebar 25 covered by frictionally maintained resilient tubular padding 26 to aid in preventing injury to a user of the device.

All of the body elements except the handlebar are preferably formed of wood and as illustrated may be quite simply and conveniently formed from standardized sheet stock. The various elements are mechanically interconnected by traditional fastening methods including adhesion, nailing and bolting. The handle bars are preferably formed in two pieces and structurally maintained in appropriate holes in the body structure by adhesion. Bolting at points of particular stress or strain tend to add structural integrity.

Wheel structures 12 include forward wheel 27 and rearward wheel 28 carried respectively by the lower portions of front wheel supports 21 and rear wheel supports 22. The exact configuration of these wheels, so long as they have a circular periphery, is not particularly critical to my invention. In the instance illustrated, they comprise solid wheels formed from sheet wood stock. The two wheels are similar to each other and each is provided with a bushing type bearing 29 to provide rotatable mounting upon a wheel axle. The positioning of the wheels relative to the other structures is somewhat critical as hereinafter set forth.

The body structure and wheel structures are supported in a medial position above the rocker structure by similar paired, opposed "Z" shaped forward body supports 30 and rearward body supports 31, each having substantially vertically oriented and parallel wheel flanges 32 and rocker flanges 33 interconnected by body 34. The rocker flanges define holes 35 to accept nut-bolt combinations 36 extending through the rocker and wheel flange to mechanically interconnect the members. Wheel flanges 32 define medially positioned axle holes 37 to accept the cylindrical shanks of bolt type axles 38.

The body supports are shaped and dimensioned substantially as illustrated in FIG. 1 so that similar paired opposed supports extend inwardly from each rocker to proximity with each wheel so that the wheel may be rotatably positioned therebetween. Bolt type axles 38 extend through each wheel support, each cooperating pair of body supports and the associated wheel therebetween to mount the wheel and body on the rocker structure and yet allow rotation of the wheels. Bearings 29 are configured to nicely fit upon the shank of bolt axle 38 to provide a rotatable bearing for the wheel on that axle.

Preferably for strength and rigidity the body supports will be formed of metal such as strap steel.

The dimensioning and positioning of the wheels relative to the rocker structure, as shown particularly in FIG. 5, is critical to the operation of my invention. The front wheel must be of such size and so positioned that it extends slightly below the lowermost surfaces of the foreward portions of the rockers laterally adjacent thereto. With this structure, when the rockers move to their forwardmost position, their forward portion will be raised above the supporting surfaces and the forwardmost portion of my toy will be supported on the periphery of the forward wheel. The rear wheel is so positioned that its lowermost surface will be immediately above the surface supporting the rocker structure when the rocking cycle reaches its rearwardmost extent. The rear wheel then will contact the supporting surface to prevent any further rearward rocking motion and, thusly aid in preventing the top from tipping in a rearward direction.

Having thusly described the structure of my invention, its operation may be understood.

Firstly a wheeled rocker toy is formed as specified. A rider mounts the toy, seats himself upon seat 23, places his feet on foot rests 24 on each side of the device and grasps the outer handle portions of handlebars 25 with his hands. The rider then moves the mass of his body forwardly and rearwardly in cyclical fashion to establish and reinforce a rocking motion of the toy. This rocking motion is increased in intensity until it be such as to bring front wheel 27 of the toy into contact with the underlying supporting surface.

As this contact between front wheel and supporting surface occurs, there will still be somewhat of a rocking motion when the wheel contacts the underlying supporting surface and because of this the inertia of the toy will have somewhat of a forward component relative to its supporting surface. This forward component of force will be exhausted by moving the toy forwardly a distance against the frictional force of reaction between the supporting surface and the rearward portions of the rockers. So long as the rocking motion be continued at the same intensity, the locomotion cycle will be repeated by each rocking cycle and the toy will tend to move forwardly responsive thereto.

Since the rear wheel does not contact the underlying supporting surface at the normal rearward limits of the rocking cycle all force of the rocking cycle will be exhausted in the rocking motion and will not tend to move the toy rearwardly. The rear wheel, however, is so dimensioned and positioned as to contact the underlying supporting surface if the rearward rocking cycle be more violent than the forward cycle and of sufficient amplitude to cause the toy to tip over rearwardly so as to act as a safety feature and prevent rearward tipping.

It is to be noted that the normal rocking toy, epitomized by the rocking horse as heretofore known, does not in normal operation provide any linear motion responsive to a normal foreward rocking cycle and does not have any features to prevent rearward tipping of the device, other than the rockers themselves.

The foregoing description of my invention is necessarily of a detailed nature so that a specific embodiment of it may be set forth as required, but it is to be understood that various modifications of detail, rearrangement and multiplication of parts might be resorted to without departing from its spirit, essence or scope.

Having thusly described my invention, what I desire to protect by Letters Patent, and,

What I claim is:

1. A wheeled rocker toy comprising, in combination:

rocker structure providing similar opposed elongate rockers in spaced, parallel relationship, each of said rockers having similar arcuate lower surfaces to simultaneously contact a planar supporting surface;

a rigid body structure supported between and above the rockers, said body having a seat in its upper portion to support a user paired opposed foot rests in its lower medial portion to support the feet of a user, handlebar structure in its upper forward portion to support the hands of a user;

forward wheel support structure depending from the forwardmost part of the body structure to rotatably support a front wheel, said wheel being configured and positioned to contact an underlying supporting surface before the rockers have reached their forwardmost rocking limit to then support the forward portion of the toy to allow its forward linear motion relative to the supporting surface; and rearward wheel support structure depending from the rearwardmost part of the body structure to support a rearward wheel, said wheel being configured and positioned to contact an underlying supporting surface at the time the rockers have reached their rearwardmost rocking position to aid in preventing the toy from tipping rearwardly.

* * * * *